US006418585B1

(12) United States Patent
Viner

(10) Patent No.: US 6,418,585 B1
(45) Date of Patent: Jul. 16, 2002

(54) POWERED MOP ADAPTABLE FOR ELECTRO-MECHANICAL OPERATION

(76) Inventor: Sam Viner, 14010 Captains Row #228, Marina Del Rey, CA (US) 90292

( * ) Notice: Subject to any disclaimer, the term of this patent is extended or adjusted under 35 U.S.C. 154(b) by 0 days.

(21) Appl. No.: 09/658,404

(22) Filed: Sep. 8, 2000

(51) Int. Cl.[7] ..... A47L 13/146
(52) U.S. Cl. ..... 15/119.2
(58) Field of Search ..... 15/116.2, 119.1, 15/119.2

(56) References Cited

U.S. PATENT DOCUMENTS 2,204,806 A * 6/1940 Lorenz et al.
2,648,086 A * 8/1953 Vidal
4,216,562 A * 8/1980 Strahs
5,625,918 A * 5/1997 Kieson
5,896,613 A * 4/1999 Courtney et al.
6,119,297 A * 9/2000 Ohm et al.

* cited by examiner

*Primary Examiner*—Terrence R. Till
(74) *Attorney, Agent, or Firm*—Natan Epstein

(57) ABSTRACT

An improved mopping device which may be adapted for manual or electro-mechanical operation, comprising a plastic plate the underside of which is provided with a sponge, the plate having a pair of parallel spaced apart grooves about each of which a part of one side of the plate may be hinged, the area between the grooves being fixedly secured to a solid rigid core constituting at least a lower section of the mop handle, and a sleeve slideable up and down said core and attached to rotate the side portions of the plate together about their groove hinges to squeeze the sponge after it has been applied to pick up liquid on a surface.

7 Claims, 12 Drawing Sheets

POWERED MOP ADAPTABLE FOR ELECTRO-MECHANICAL OPERATION

FIELD OF THE INVENTION

This invention relates generally to the field of cleaning devices and specifically to a mop suitable for use in cleaning windows, floors and decks on which fluids may have spilled. The mop may be constructed either to operate manually, or by an electro-mechanical power arrangement.

BACKGROUND OF THE INVENTION

The earliest mops comprised a handle at the lower end of which was provided some type of expanded wiper formed of cloth or absorbent rope ends which, when passed over an area containing water or other liquid, would tend to absorb the liquid and enable it to be deposited in a bucket or other receptacle. In order to extract the collected liquid from the fabric or other liquid absorbing material, provision was made for some type of wringer on the edge of the bucket. This required the liquid absorbing material to be passed between rollers or some other squeezing device to result in depositing the liquid in the bucket.

Recognizing the inconvenience of having to wring out the mop head by a bucket-mounted wringer, inventors have undertaken to devise various means for squeezing water out of such mop head, which means are disposed on the mop handle itself. Such means provide in some way to encompass the liquid absorbing material and squeeze it. These expedients were facilitated by the substitution of sponge-like material for the cloth or other fabric originally used on mops. An example of such a mop is illustrated and described in U.S. Pat. No. 5,528,791. While this and other types of mops may be effective in certain applications, their operation requires a certain degree of physical strength to pull the sponge-like wiping material up into, and between, a pair of rollers or other squeezing elements, to effect the discharge of water or other liquid material picked up by the sponge-like wiper.

In an effort to decrease the amount of physical exertion required to draw the liquid absorbing sponge-like material between squeezing elements, it has been proposed to provide a hollow handle for a self-wringing mop, through which handle, a detachable threaded element may extend from a source of power to be rotated as a drive to draw the sponge material after wetting, between rollers. An example of this approach to a self-wringing mop may be seen in U.S. Pat. No. 5,933,904. The difficulty with this approach, however, is that, in order to rotate the shaft effectively to draw the mop between the squeezing rollers, far more power is required than can be provided by any motor with batteries which are small enough to avoid making the mop handle completely unwieldy.

It would, nevertheless, be desirable to have a self-wringing mop which could pick up water or other liquid and then be able to discharge that liquid into a bucket without undue physical exertion, or having a mop handle which is of such size and weight to render it unwieldy in its use by an average cleaning person.

SUMMARY OF THE INVENTION

The present invention provides a self-wringing mop which is neither heavy nor unwieldy and, in one preferred embodiment, may be operated by a mini electric motor powered by four AAA regular or rechargeable batteries disposed preferably in the upper of three sections comprising the mop handle. The bottom section of the mop handle includes a solid cylindrical core, the lower end of which is secured to a plate. The underside of the plate may be covered by sponge-like material. The intermediate section of the mop handle may have a mini high speed electric motor, a gear train terminating in a pinion which engages a rack which may be advanced and retracted. The rack is connected to a sleeve which is slideable up and down the core. The sponge-like material is disposed on the lower face of an orificed plastic plate which is hinged around two parallel groove lines spaced apart from each other and transverse to the axis of the core of the lower section. One of the grooves of the plastic plate is disposed more closely to the one transverse edge of the plate than the other groove is distanced from the opposite edge of the plate. The latter edge of the plate is turned to extend for a short distance down the side of a rectangular sponge. The opposite edge of the plate is also similarly turned and desirably may extend further down the side of the sponge. The portion of the plate intermediate of the grooves is secured by an I-beam to the lower end of a rigid core member extending through the sleeve to a fixed position in the intermediate section of the mop handle. The lower end of the sleeve or tube terminates in a housing assembly having a rectangular upper area face normal to the axis of the tube and secured to the lower end of the tube. The tube is preferably flared out to increase the area of the rectangular upper face of the housing to which face the tube is attached.

The housing extends downwardly and its sides are opened up each to terminate in two flat fingers which initially angle slightly apart from each other, but terminate somewhat angled back toward each other. The forward fingers of each pair are angled to a greater degree than the rear fingers. All fingers are slightly rounded at their ends. The open spaces between the fingers on each side are of sufficient area to permit the housing to be moved down over the I-beam attached to the plastic plate for a relatively short predetermined distance.

Additional grooves are provided on the top of the plastic plate to receive the lower ends of the fingers of the housing and to permit them to be moved forwardly and rearwardly over the plate, thereby to bend the outer hinged portions of the plate about their respective transverse grooves.

With the arrangement thus described, when the power button is pushed, the rack is moved by the mini motor through the gear train. Downward advancing of the rack which is attached to the tubular portion, results in moving the lower ends of the fingers of the housing across the vertical grooves in the hinged plate to force the outer hinged sections of the plate to pivot about their respective groove hinges towards each other, thereby tightly encompassing the sponge attached to the underside of the plate to squeeze water or other liquid from the sponge. The water may pass through the orifices in the plate and out of the ends of the sponge.

Release of the power button results in the retraction of the rack and its attached tube and the fingered housing at its lower end. With such withdrawal, the hinged plate may return to its near planar status to present the sponge face for further use.

While the preferred embodiment is operated by a battery powered mini motor, the squeezing arrangement itself is a separate part of the present invention, and may be utilized manually. This may be accomplished by simply having the outer tube slideably disposed over a solid immovable core comprising the lower section of the handle, the lower end of which is secured to the I-beam. Manually sliding the outer tube downwardly will cause the fingers of the housing to move over the plate in the same manner as previously described.

It may be seen from the foregoing and the detailed description of the invention with reference to the drawings hereinafter provided, that the applicant has described an advanced and improved self-squeezing mop which may be utilized by persons with minimum strength. Even when the mop is constructed for manual operation, it will be found to require little force to move the lower sleeve downwardly to squeeze the sponge portions of the mop head. In addition, because of the utilization and construction of readily available parts which can be easily fabricated, the self-cleaning mop of the present invention may be manufactured and sold at a reasonable price.

DESCRIPTION OF THE DRAWINGS

In the accompanying drawings.

DESCRIPTION OF THE PREFERRED EMBODIMENT

Figure 1:
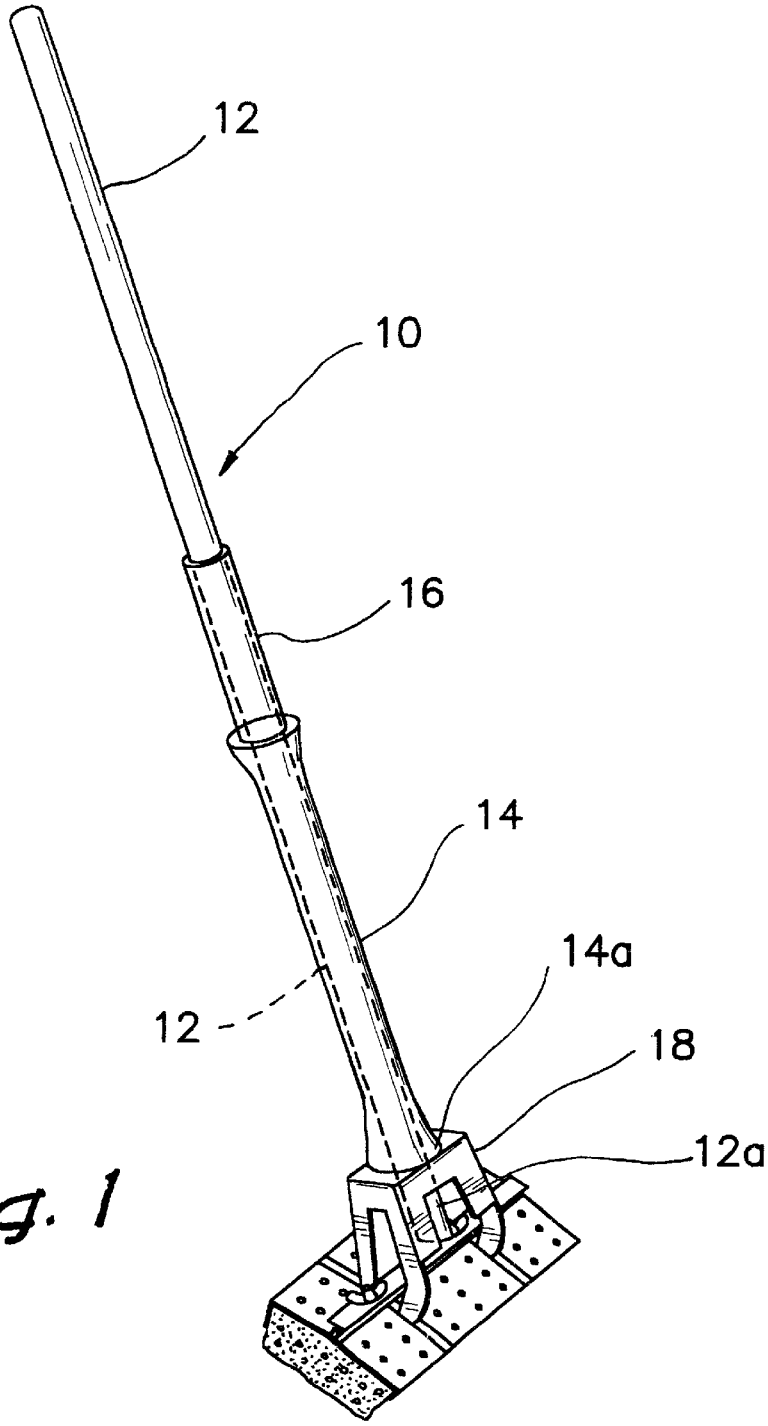
FIG. 1 is a perspective view of a manually operable mop utilizing a portion of the present invention.

Referring to FIG. 1 of the accompanying drawings, the basic mop 10 may comprise a solid handle core 12 and a tubular lower section 14. The tubular section 14 is slideable with respect to the core 12 between a lower plate closing position shown in FIG. 5, and a plate open position shown in Figure in which latter position the lower section 14 may abut a fixed sleeve 16 which may also serve as a grip for the center of the core 12. The tubular section 14 terminates at its lower end 14*a* in a housing 18. As better shown in FIG. 2, the housing 18 includes an upper rectangular portion 18*a*, front and back walls 18*b* and 18*d* and side walls 18*c* and 18*e*. Each pair of walls 18*b*, 18*d* and 18*c* and 18*e* opens up below the upper rectangular housing portion 18*a* to result in two pairs of fingers 20, 20*a* and 22, 22*a*. The fingers 20, 22 are angled downwardly and rounded at their ends 20', 22'. As better seen in FIG. 3, the fingers 20*a* and 22*a* at their lower ends, 20*a*' 22*a*' are slightly turned inwardly and also rounded.

Figure 2:
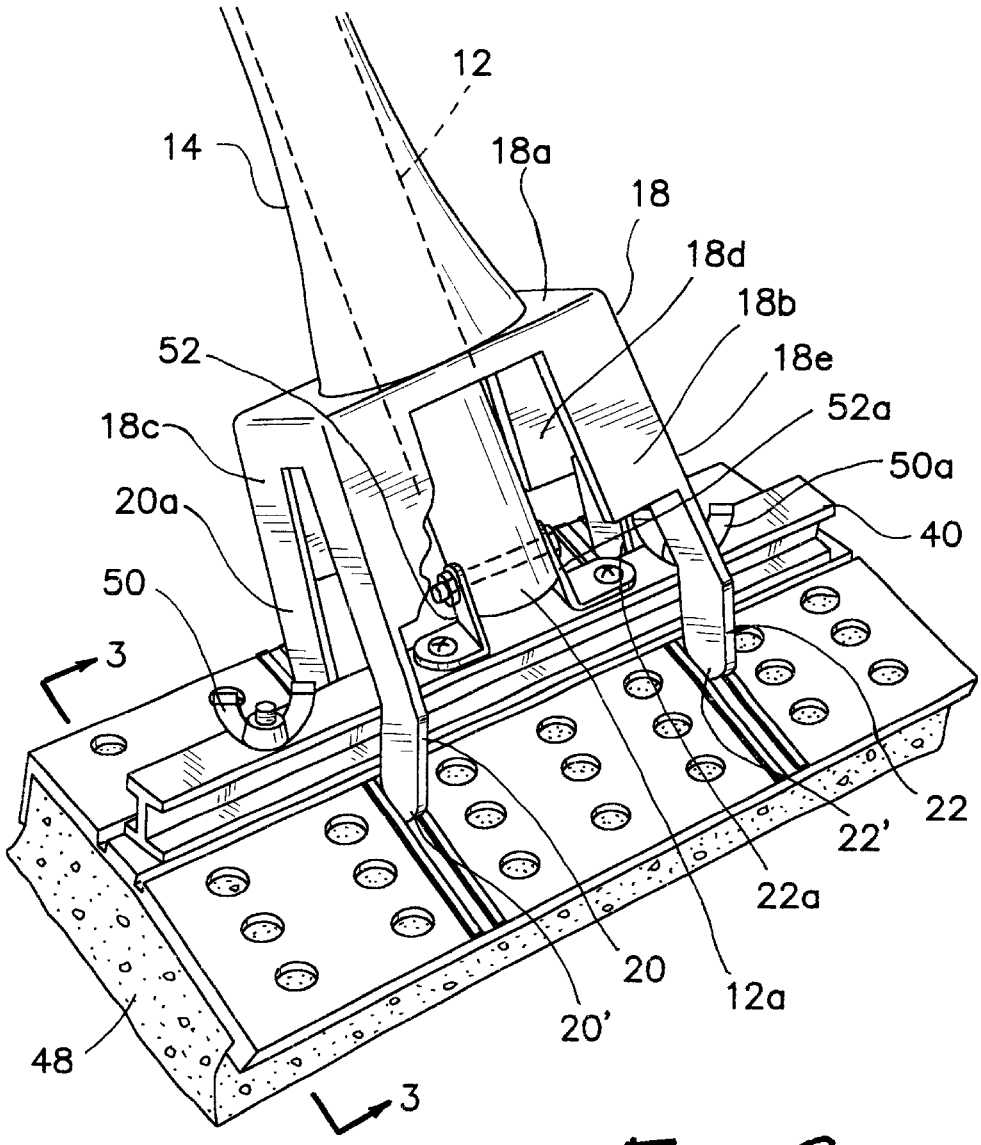
FIG. 2 is an enlarged view of the mop head of FIG. 1.
Figure 2A:
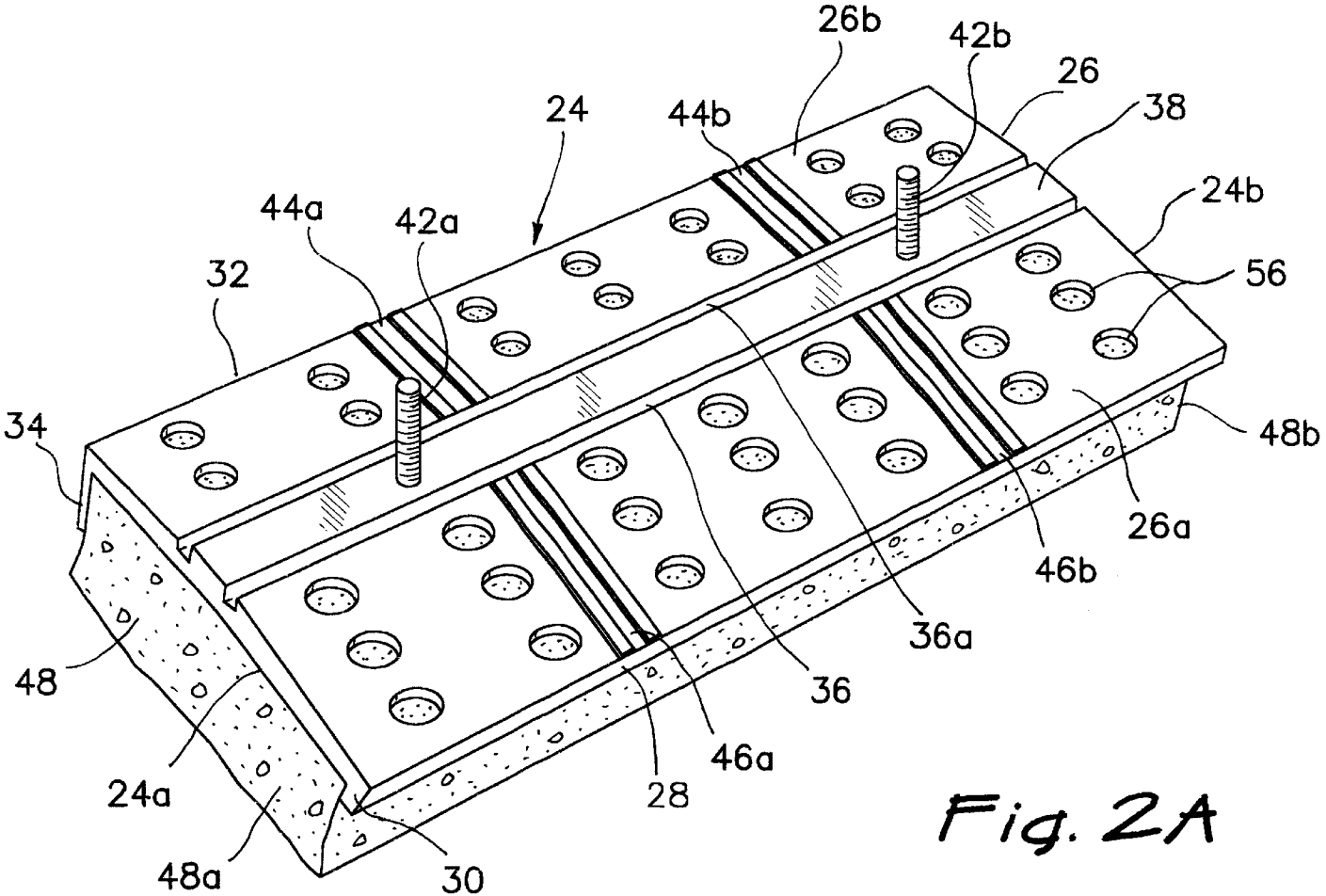
FIG. 2A is a still further enlargement of the sponge holding plate of the mop head shown in FIG. 2.

The actual cleansing element 24 is best shown in FIG. 2A and comprises an orificed plastic plate 26 having a front end 28 which is turned downwardly for a short distance at 30, and a rear end 32 which is turned down for a greater distance at 34. The central area of the plate 26 has a pair of parallel transverse grooves 36, 36*a* which are preferably rectangular in cross section, are spaced apart from each other and extend from one end 24*a* of the plate 24 to the other end 24*b*. The effect of providing the grooves 36, 36*a*, is to enable the forward section of the plate 26*a* to bend downwardly in a hinge-like manner at the groove 36; and the after section of the plate 26*b* to bend downwardly in a similar manner about the groove 36*a*. The area 38 between the grooves 36, 36*a* serves to receive an I-beam 40, shown in FIG. 2, which may be secured to the area 38 by bolts 42*a*, 42*b*, the heads of which (not shown) may be disposed in the underside of the area 38.

The rear section 26 of the plate 24 is provided with a pair of parallel grooves 44*a*, 44*b* which are spaced from each other and extend at right angles to the groove 36*a*. In a similar manner, a front section 24*b* of the plate 24, is provided with a pair of grooves 46*a*, 46*b* which are aligned respectively with the grooves 44*a*, 44*b* and terminate at right angles with the groove 36.

The underside of the plate 24 has secured to it and extending between the turned down edge portions 30, 34, a rectangular sponge 48. This thus-described plate is attached to the I-beam 40 by the bolts 42*a*, 42*b* and secured by wing nuts 50, 50*a*, respectively as best shown in FIG. 2. The I-beam 40 is centrally pivotally mounted on the lower end 12*a* of the core section 12 by means of the angles 52, 52*a*.

Figure 3:
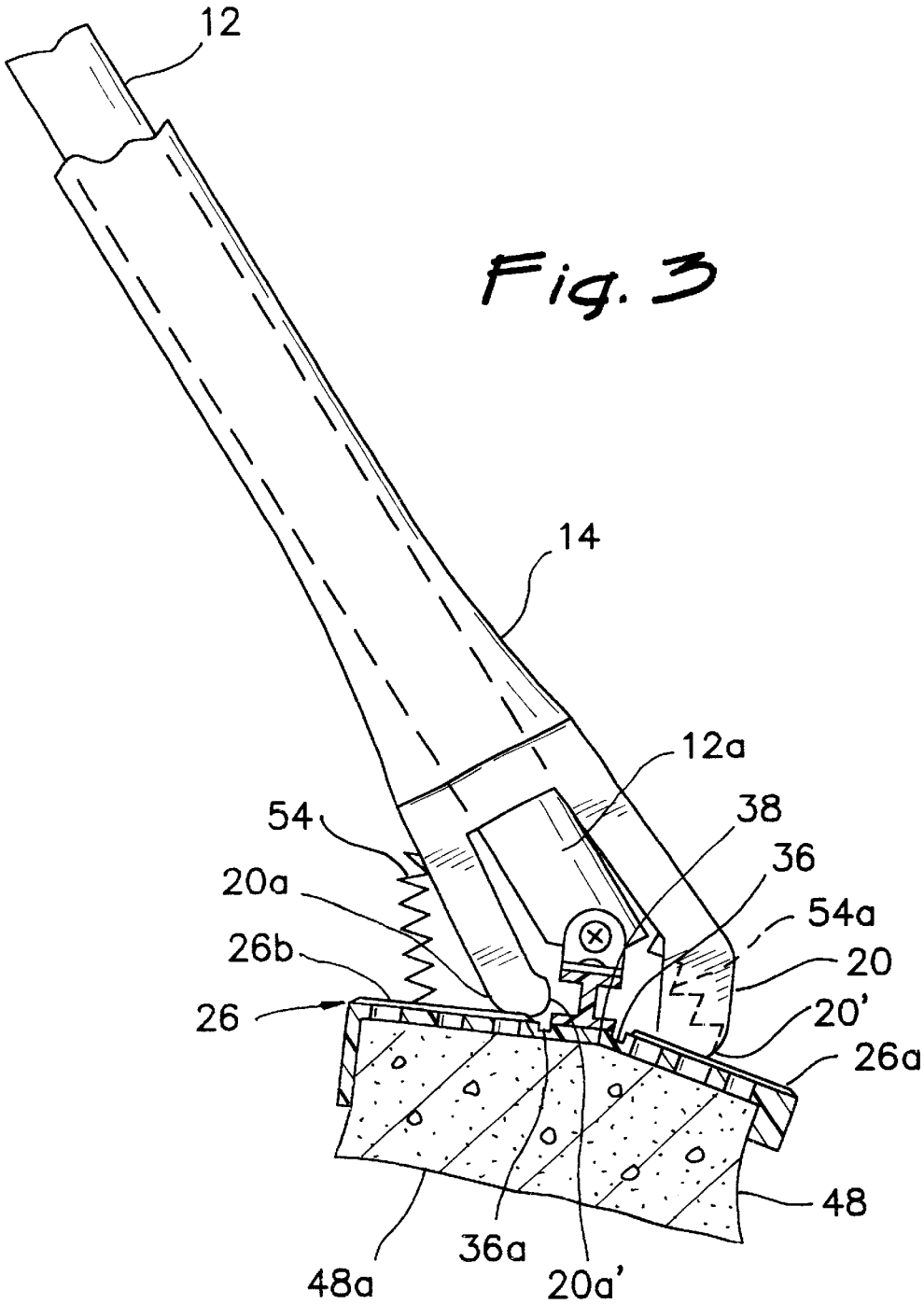
FIG. 3 is a side elevation partly in section looking in from the right side of the lower section of the mop of FIG. 1.
Figure 4:
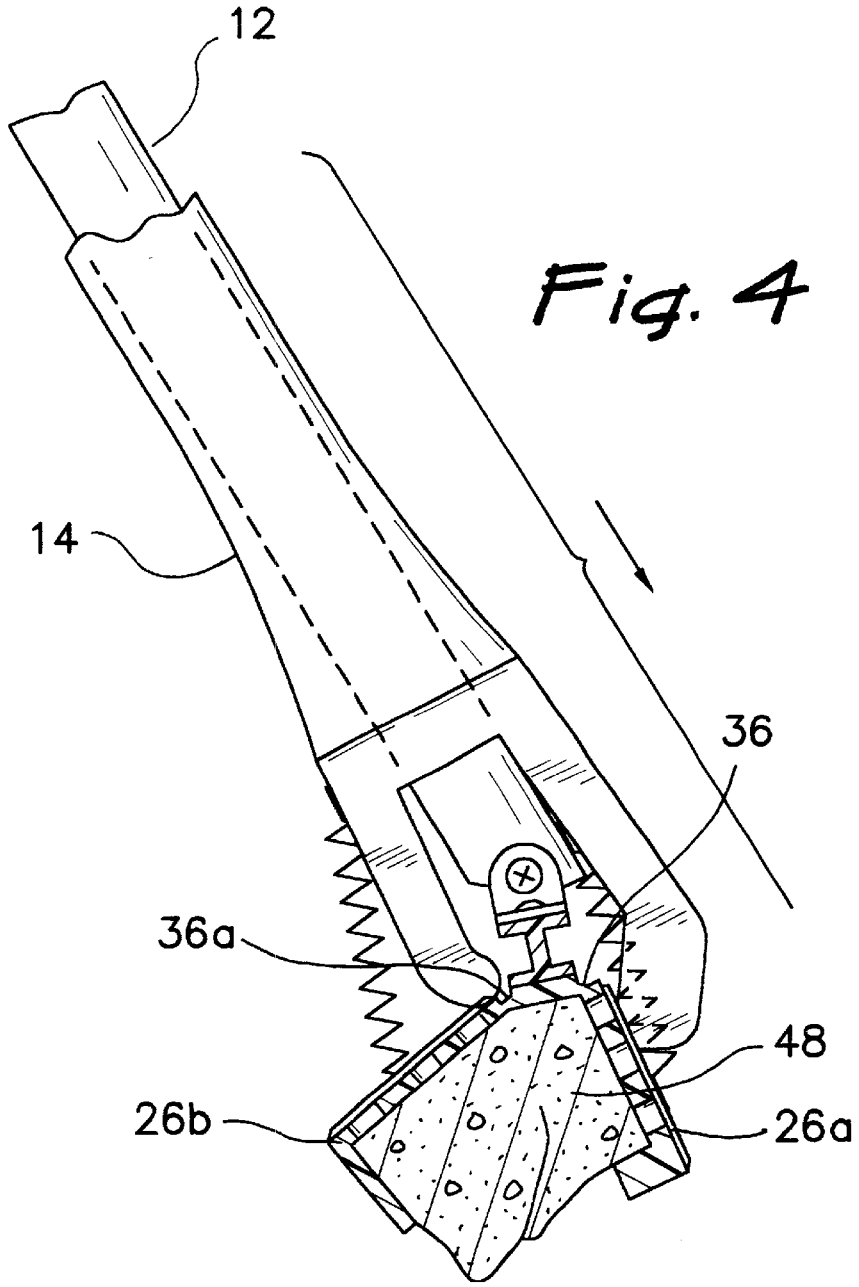
FIG. 4 is a sectional view similar to FIG. 3 but showing the first stage of the bending of the sponge carrying plastic plate.
Figure 5:
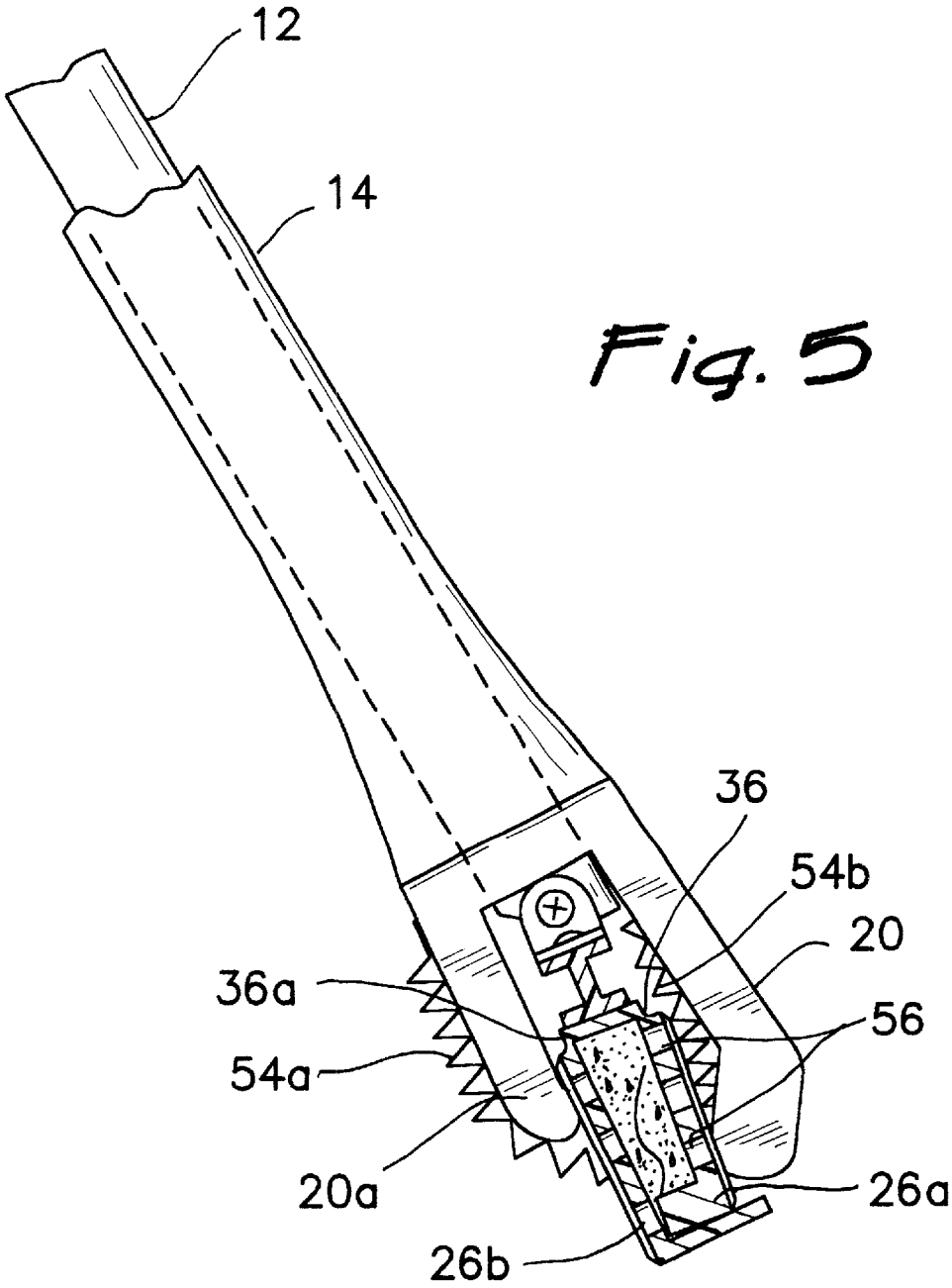
FIG. 5 is a view similar to FIGS. 3 and 4 but showing the completion of the bending stage of the sponge-carrying plate, resulting in squeezing of the sponge.

FIGS. 3, 4 and 5 illustrate the manner in which the mop of the present invention is operated. FIG. 3 shows the mop in its cleaning position. In this position, the three sections of the plate 26, namely, the front section 26*a*, the after section 26*b* and the central portion 38 are disposed to hold the sponge 48 with its cleaning face 48*a* presented for application to a floor or window. As shown in FIGS. 3 and 4, after the sponge has been applied to a wetted surface of a floor, deck or window (not shown) and it is desired, in effect, to wring out the sponge 48, the lower tubular section 14 is forced downwardly relative to the central core section 12, with the result of the fingers 20*a* and 22*a* being advanced in the grooves 44*a*, 44*b*, respectively, and the fingers 20, 22 simultaneously being advanced in the grooves 46*a*, 46*b*. Thereby, the rear portion 26*b* of the plate 26 is bent in a hinge-like manner about the groove 36*a*, while simultaneously, the forward section of the plate 26*b* is bent about the groove 36*a*, thereby initiating the encompassing of the sponge 48. Further advancement of the tube or sleeve 14 results in the fingers 20, 20*a*, and 22, 22*a*, advancing to their limits in the grooves 44*a*, 44*b*, 46*a*, and 46*b*, respectively,. to complete the pivoting of the plate sections 26*a*, 26*b* to bend those sections into the interlocking configuration shown in FIG. 5, to effect a squeezing of the sponge 48.

Because the plate sections 26*a* and 26*b* are provided with a series of orifices 56, when the sponge 48 is squeezed in the manner shown in FIG. 5, water entrained in the sponge 48 will exude through the orifices 56, and also from the ends 48*a,* 48*b* of the sponge 48. Upon release of any downward force applied to the tubular section 14, the springs 54*a,* 54*b* will tend to bring the bent sections 26*a,* 26*b,* of the plate 26 back to the position shown in FIG. 3.

The invention has thus far been described for manual operation of a mop constructed in accordance with the arrangement featured in FIG. 1. While this embodiment may operate successfully in the manner described, it does require some physical effort in that it is necessary for the person using the mop to grip with one hand the core section 12 of the mop, while holding the slideable sleeve section 14 and forcing the latter section down sufficiently to dispose the fingers 20, 20*a* in the position shown in FIG. 5 relative to the plate 26.

It is also a feature of the present invention to provide electro-mechanical means to move the tubular member 14' downwardly and back up in the manner shown in FIGS. 3, 4 and 5 and discussed above. In this electromechanical embodiment, which is shown in FIGS. 6, 6A and 7–11, the handle portion of the mop is comprised of three coaxial sections, namely, an upper tubular section 70, a lower solid core 12' and an intermediate housing section 64, which are secured together. The core 12' is secured at its lower end 12*a* to the I-beam 40. It is brought up (FIG. 7) and secured at 60 to a transverse wall 62 in the intermediate housing section 64. The upper end 14' of the tubular element 14*a'* is not flared outwardly as shown in FIG. 1, but is maintained as a cylindrical shape and is secured by screws 65 to a plate attachment 66 which itself may be an integral extension of a rack 68 hereinafter described.

The housing 64 (FIG. 6) has its upper end 64*a* secured to the tubular section 70 which may contain a plurality of batteries 72, preferably of the regular or rechargeable AAA type. These batteries 72 may be connected by wires 74 through the top end 64*a* of the housing 64. There may also be mounted on the upper end of the housing 64*a* a switch 76.

Figure 8:
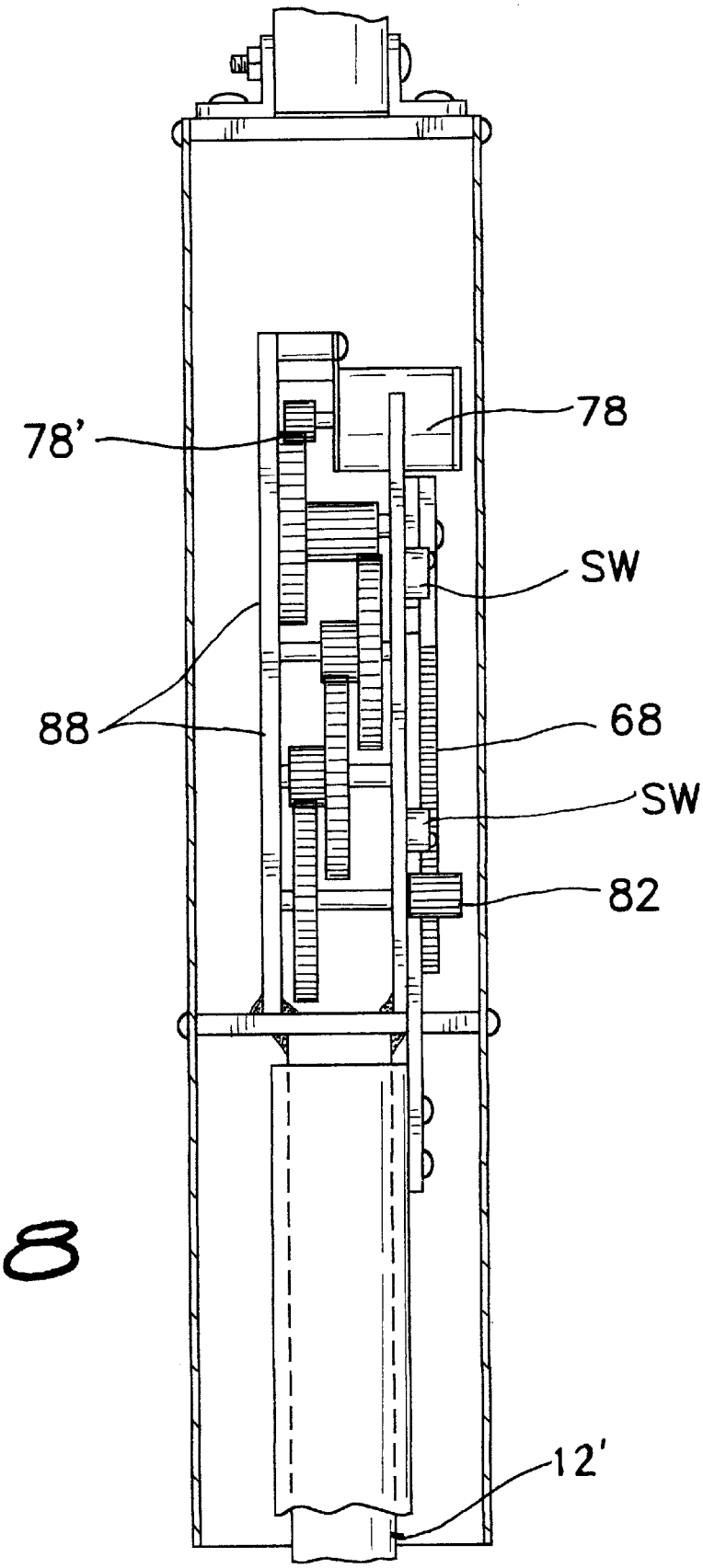
FIG. 8 is a plan view partly in section looking in the left side of FIG. 7 to show the gear train.
Figure 9:
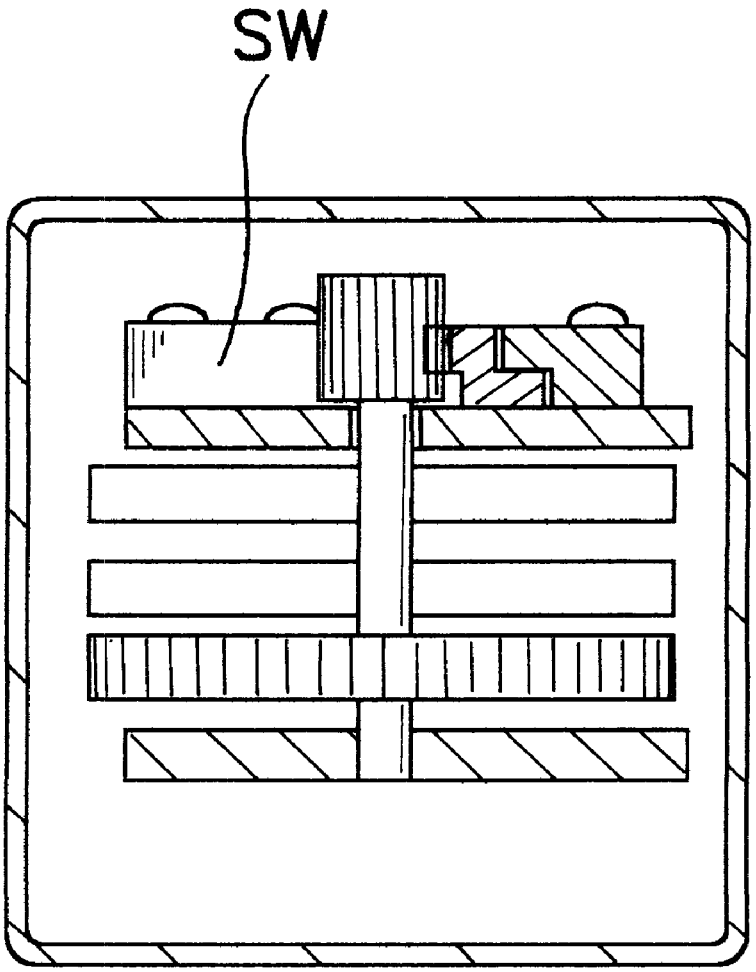
FIG. 9 is a section taken on the line 9—9 of FIG. 7 looking in the direction of the arrows.

Within the housing 64 there may be provided a high speed electric mini motor 78 driven by power from the four batteries 72. However, in order to convert the high speed of the mini motor 78 to a pinion drive of the rack 68, there is provided a gear train 80 as shown in FIGS. 8 and 9. The output of this gear train, starting with the mini motor driven pinion 78' devolves to a pinion 82 engaged with the rack 68.

Figure 7:
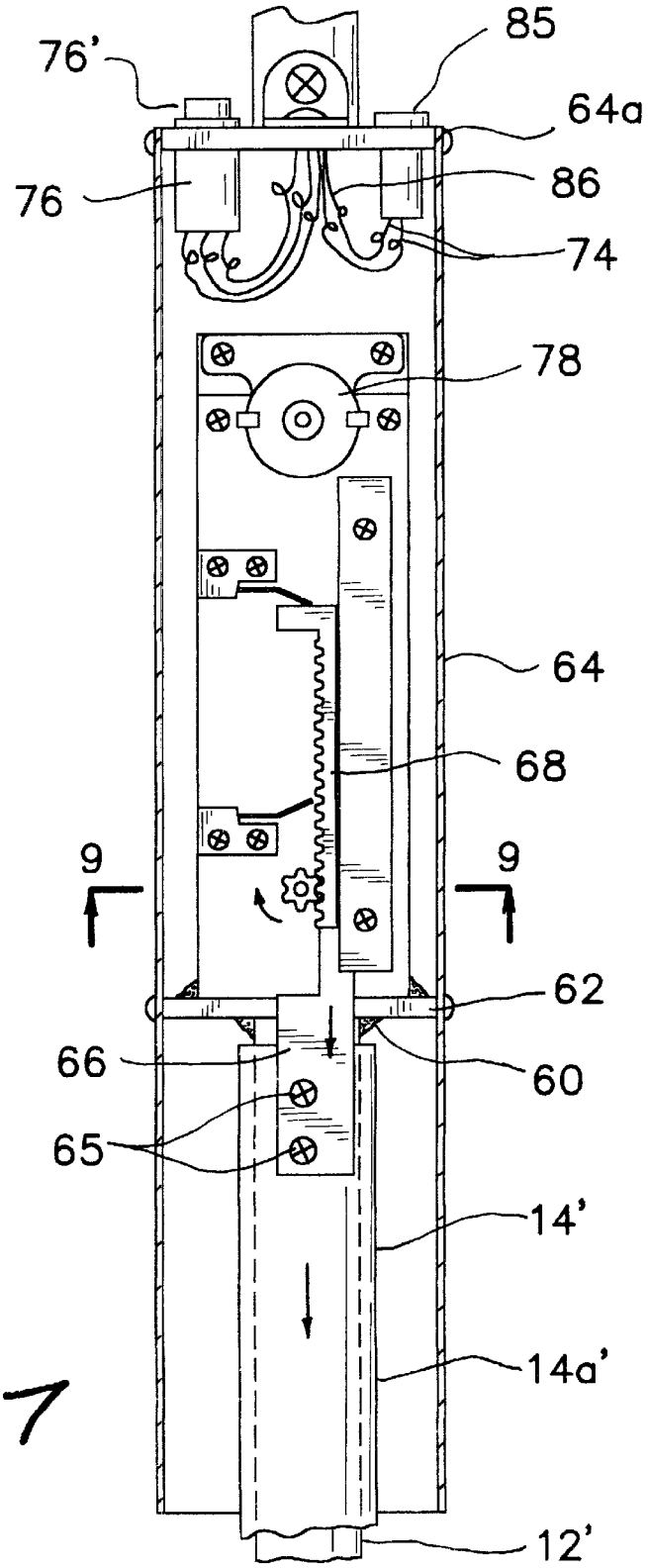
FIG. 7 is a section cut of the rectangular portion of the mop handle shown in FIG. 6.
Figure 11A:
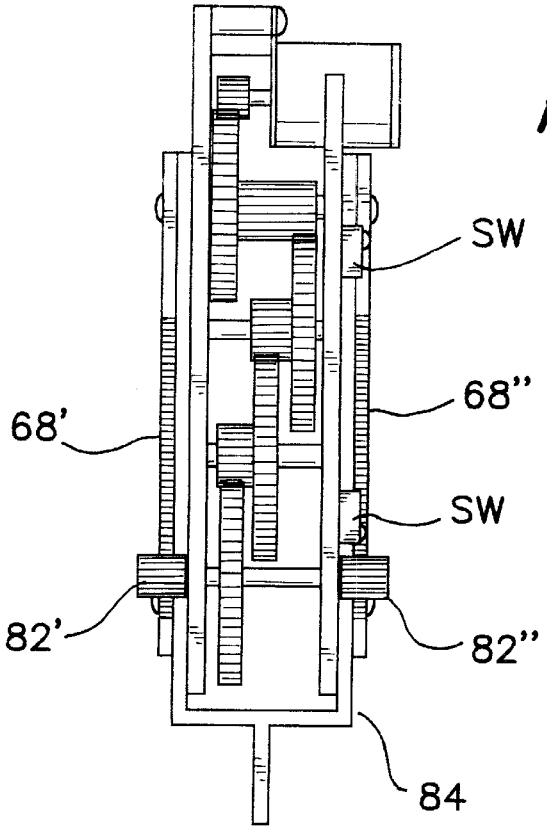
FIG. 11A shows a modification of FIG. 11 to provide a double rack pinion drive for the two arms of a yoke for connection to the slideable tube shown in FIG. 8.
Figure 11:
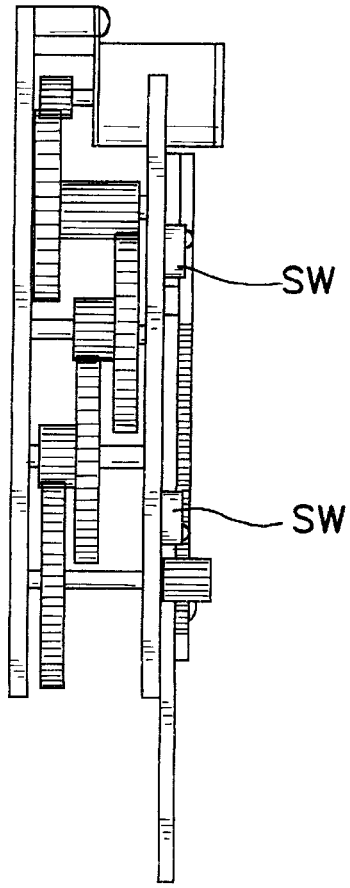
FIG. 11 is a plan view of the gear train incorporated in FIG. 8.

In the alternate embodiment shown in FIG. 11A, instead of a single pinion 82, the gear train may be arranged to drive a pair of co-axial pinions 2' and 82", each of which is connected to a rack 68', 68", respectively, with both racks being attached to a Y-drive 84, with the latter being secured to a slideable tubular element 14' (shown in FIG. 7).

Figure 10:
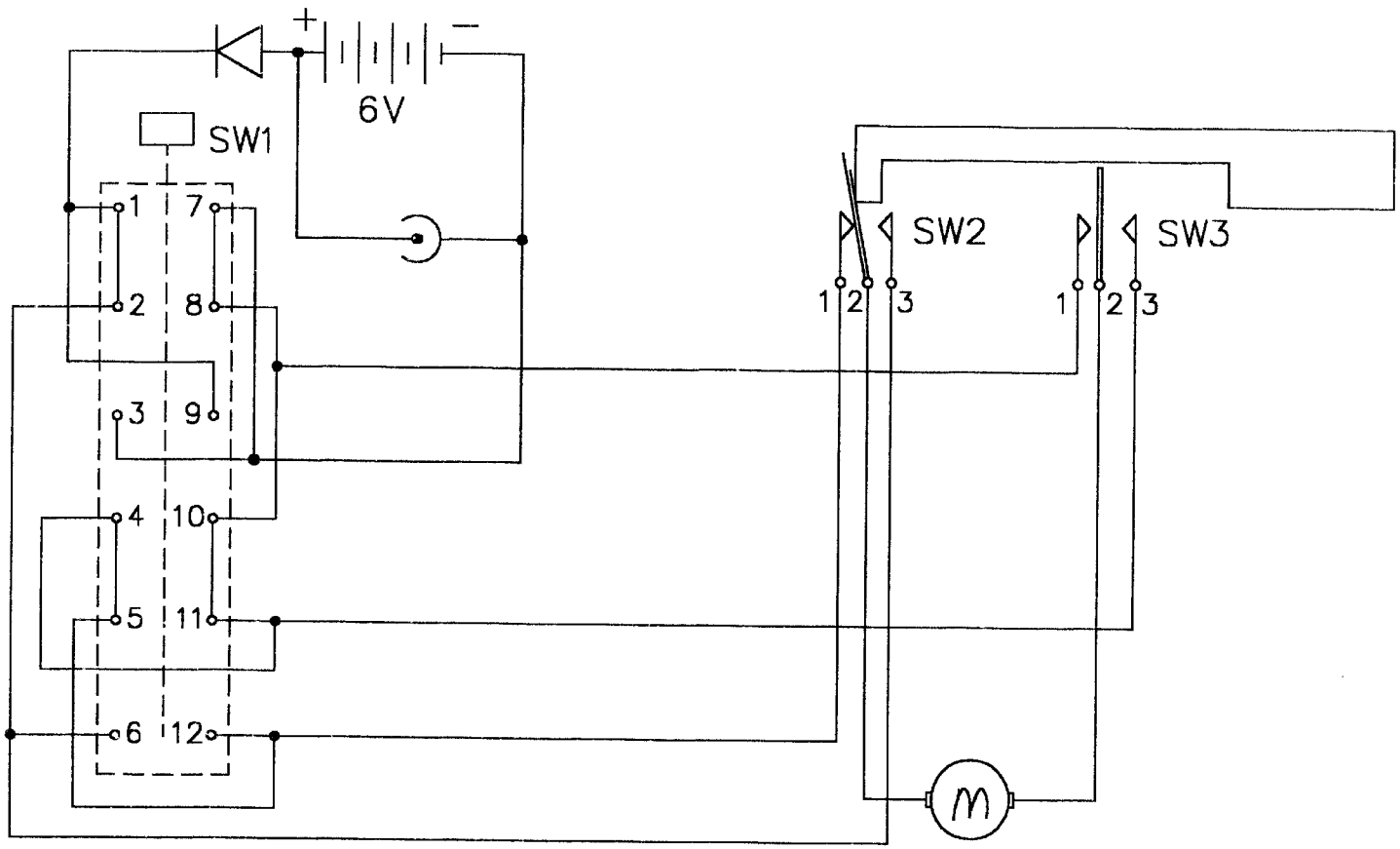
FIG. 10 is a schematic circuit diagram showing the battery, the mini motor and the switching arrangement by which electrical power from the battery may operate the reversible mini motor to produce the required advancing and retraction of the lower tubular section of the mop handle.

Electrical circuitry, as shown in FIG. 10, may be employed to connect upon the pressing of a switch button 76' (FIG. 7) to accomplish the following functions:

A) Initially to connect the four batteries 72 to the mini motor 78 to initiate rotation of the mini motor.

B) However, when the pinion 82 has driven the rack downwardly sufficiently to dispose the fingers 20, 20*a* about the plates 26*a,* 26*b* in the position shown in FIG. 5, not only to cease further power connection to the motor, but simultaneously to short the mini motor 78 to prevent its further rotation.

C) To initiate reversal of the mini motor 78, thereby to drive the rack back upwardly and to carry with it the tubular element 14', thereby re-disposing the fingers 20, 20*a,* relative to the plate sections 26*b,* and 26*a* back to the position shown in FIG. 3.

D) To cut off further power to the mini motor 78 when the rack reaches its upper limit, while simultaneously shorting the mini motor 78 to prevent damage caused by inertial rotation.

Figure 6:
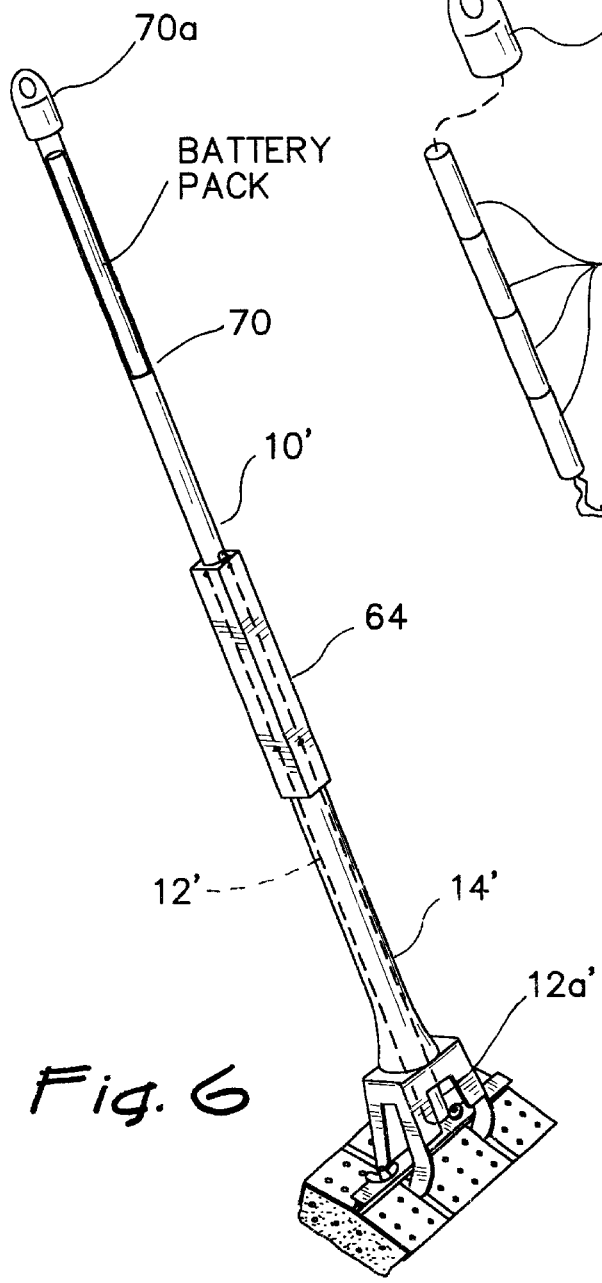
FIG. 6 is a perspective view similar to FIG. 1, but showing a battery powered electromechanical embodiment of the present invention.
Figure 6A:
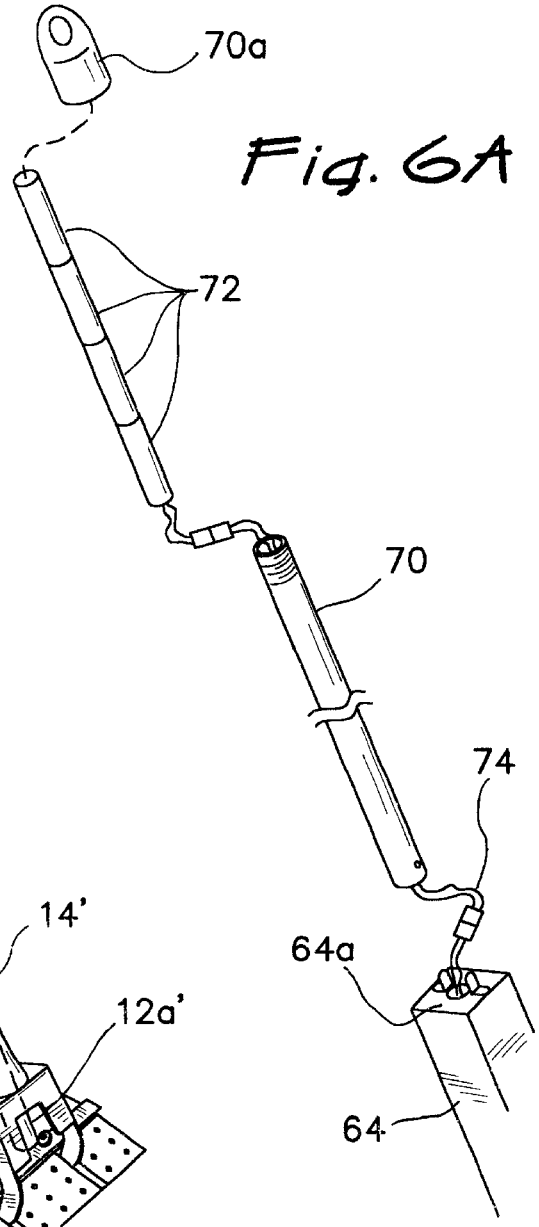
FIG. 6A is an enlarged exploded perspective view of the upper section of the mop shown in FIG. 6, with the several parts detached from each other.

In this electromechanical embodiment water or other liquid picked up by the sponge 48 may be easily and frequently discharged by simply pressing the button switch 76', and releasing it when the water or liquid has been squeezed out from the sponge, thereby to return the tube 14' to its upper disposition with the sponge 48 then presented in the manner shown in FIGS. 1, 6 and 3.

Because use of a gear train with rack and pinion at ratio of 400:1 allows use of the reversible mini motor 78, the batteries will be found to last for several hundred squeezings of the mop in the manner herein described. However, replacement of the batteries in the tube 70 is a simple matter, it being only necessary to remove the cap 70*a* on the upper tube 70, and exchange new batteries for those in the tube.

Alternatively, if re-chargeable batteries are being used, one simply connects the battery recharger 85 (FIG. 7) which itself is connected to the batteries of wires 86, to a source of current (not shown).

What is claimed is:

1. A mop for cleaning windows, floors, decks and other surfaces on which fluids may have been spilled, said mop comprising:

A) a solid rigid elongated cylindrical lower handle member, said member terminating in a lower end;

B) a rectangular plastic plate, said plate having an upper face and a bottom face, the bottom fade being covered with a water absorbing sponge-like material, the upper face having a first pair of spaced apart parallel grooves, extending lengthwise from one edge of the plate to its opposite edge, the space between said first pair of grooves being fixedly secured to a rigid support member, said support member being fixedly attached centrally to the lower end of the lower handle member at an acute angle with respect to the axis of said handle member; said plate being bendable in a hinge-like manner about each of said first pair of grooves outwardly of said rigid support member, thereby dividing the plate into a forward hinged plate section and a rear hinged plate section on opposite sides of said rigid support member, each said hinged plate section having a second pair of spaced apart parallel grooves normal to the first pair of grooves with one groove on each side of the lower end of the lower section of the handle member where said lower end is attached to said rigid support member;

C) a sleeve-like element slideably disposed on the lower handle member and adapted to be moved from an upper plate open position to a lower plate closing position, the lower extremity of said sleeve-like member terminating in a housing having an upper portion and a lower portion, the lower portion of said housing comprising a forward pair of flat fingers and a rearward pair of flat fingers, the forward pair of fingers being rounded and each being slideably disposed on one of the second pair of grooves in the forward hinged plate section, and the rearward pair of fingers each also being rounded at its lower extremity and being disposed in one of the second pair of grooves in the rear hinged plate section, the forward edge of said forward hinged plate section being turned downwardly around the edge of the sponge-like material, and the rear edge of the rear plate section being turned downwardly, also around the sponge-like material, whereby, when the sleeve-like element is moved downwardly on the lower handle member from the upper plate open position to its lower plate closing position, the fingers are moved in their respective grooves to push the forward and rear hinged plate sections of the plastic plate in a hinge-like manner about said first pair of grooves, and to bring the two sections together to squeeze the sponge-like material on the underside of the plate.

2. The mop as described in claim 1 wherein the forward and rear hinged plate sections of the plate are each provided with a multiplicity of orifices through which water may be discharged when the forward and rear hinged plate sections of the plate are rotated toward each other about said first pair of grooves and the sponge-like material on the underside of the plate is squeezed to exude any water from such material.

3. The mop as described in claim 1 wherein said forward hinged plate section of the plate is smaller than said rear hinged plate section so that when the two plate sections are rotated about their respective hinges, the rear section of the plate at least partially encompasses the forward section.

4. The mop as described in claim 1 wherein a second housing having an upper end and a lower end is disposed co-axially with, and secured at its lower end to an upper end of the lower handle member, and electro-mechanical means are provided in the second housing to move the sleeve-like element between its first plate open position and its second plate closing position.

5. The mop as described in claim 4 wherein an upper tubular section is provided and secured to said upper end of the second housing, and said tubular section contains a plurality of batteries and there is provided in said second housing a reversible high speed mini motor connectable to the batteries; a rack is fixedly secured to the sleeve-like member; a gear train is provided between said motor and the rack to drive the rack within the second housing between an upper position in which the sleeve-like member is disposed in its plate open position and a lower position in which the sleeve-like member is moved to its plate closing position; and switching means activatable by a manual button are provided to engage and disengage the mini motor from the batteries to operate the mini motor to drive the rack in the desired direction.

6. The mop as described in claim 5 wherein the switching means is connected additionally to stop the mini motor when each said position of the sleeve-like member is arrived at.

7. The mop as described in claim 5 wherein the gear train has a ratio such that the mini motor may be driven by low current batteries such as the AAA type.

* * * * *